US009321971B2

(12) United States Patent
Janssen et al.

(10) Patent No.: US 9,321,971 B2
(45) Date of Patent: Apr. 26, 2016

(54) REMOVAL OF ASPHALTENE CONTAMINANTS FROM HYDROCARBON STREAMS USING CARBON BASED ADSORBENTS

(75) Inventors: Marcel J Janssen, Leuven (NL); John D.Y Ou, Houston, TX (US); Glenn A Heeter, The Woodlands, TX (US); Cornelis W.M. Van Oorschot, Machelen (NL)

(73) Assignee: ExxonMobil Chemical Patents Inc., Baytown, TX (US)

( * ) Notice: Subject to any disclaimer, the term of this patent is extended or adjusted under 35 U.S.C. 154(b) by 323 days.

(21) Appl. No.: 13/320,157

(22) PCT Filed: Jun. 17, 2009

(86) PCT No.: PCT/US2009/047695

§ 371 (c)(1),
(2), (4) Date: Feb. 15, 2012

(87) PCT Pub. No.: WO2010/147583

PCT Pub. Date: Dec. 23, 2010

(65) Prior Publication Data

US 2012/0132566 A1 May 31, 2012

(51) Int. Cl.

| | |
|---|---|
| ***C10G 9/00*** | (2006.01) |
| ***C10G 25/00*** | (2006.01) |
| ***C10G 25/12*** | (2006.01) |
| ***C10G 55/04*** | (2006.01) |

(52) U.S. Cl.

CPC ..... *C10G 25/003* (2013.01); *C10G 25/12* (2013.01); *C10G 55/04* (2013.01); *C10G 2300/206* (2013.01); *C10G 2300/4018* (2013.01); *C10G 2300/44* (2013.01)

(58) Field of Classification Search

CPC ..... C10G 25/003; C10G 25/04; C10G 55/04; C10G 2300/44; C10G 2300/4018; C10G 2300/206

USPC ..... 208/36, 309, 86

See application file for complete search history.

(56) References Cited

U.S. PATENT DOCUMENTS

| | | | | |
|---|---|---|---|---|
| 2,646,451 | A * | 7/1953 | Rommel | 208/310 R |
| 2,980,603 | A | 4/1961 | Van Dyck Fear | |
| 3,065,165 | A | 11/1962 | Amis et al. | |
| 3,530,066 | A | 9/1970 | Kuwata et al. | |
| 3,948,756 | A | 4/1976 | Wolk et al. | |
| 4,000,059 | A | 12/1976 | Wanless | |
| 4,176,053 | A | 11/1979 | Holcombe | |
| 4,439,313 | A | 3/1984 | Schindler et al. | |
| 4,447,315 | A | 5/1984 | Lamb et al. | |
| 4,634,516 | A | 1/1987 | Haskell et al. | |
| 4,698,146 | A | 10/1987 | Gruia | |
| 4,719,007 | A | 1/1988 | Johnson et al. | |
| 4,756,821 | A | 7/1988 | Giuliani et al. | |
| 4,765,883 | A | 8/1988 | Johnson et al. | |
| 4,775,460 | A | 10/1988 | Reno | |
| 4,804,457 | A | 2/1989 | Ngan | |
| 5,107,060 | A | 4/1992 | Yan | |
| 5,171,923 | A | 12/1992 | Dickson et al. | |
| 5,173,172 | A * | 12/1992 | Adams et al. | 208/39 |
| 5,374,350 | A | 12/1994 | Heck et al. | |
| 5,583,277 | A | 12/1996 | Kuehl | |
| 6,245,223 | B1 * | 6/2001 | Gorbaty et al. | 208/251 R |
| 6,303,842 | B1 * | 10/2001 | Bridges et al. | 585/648 |
| 6,331,253 | B1 | 12/2001 | Schrive et al. | |
| 7,566,394 | B2 | 7/2009 | Koseoglu | |
| 7,718,049 | B2 | 5/2010 | Strack et al. | |
| 2007/0131587 | A1 * | 6/2007 | Fukuyama et al. | 208/110 |
| 2009/0156876 | A1 | 6/2009 | Ou et al. | |

FOREIGN PATENT DOCUMENTS

| | | |
|---|---|---|
| CA | 2185264 | 5/2000 |
| EP | 1537912 | 6/2005 |
| WO | WO 02/100541 | 12/2002 |

OTHER PUBLICATIONS

Clark and Lynkins, Granular Activated Carbon—Design, Operation and Cost, Chelsea, Mich., Lewis Publ., Inc., 1989.*

T. Yun et al., "Effect of Clay Particle Size on the Adsorption of a Pentane Insoluble Bitumen Fraction," Clay Sci, vol. 12, Supplement 2, pp. 194-198 (2006).

* cited by examiner

*Primary Examiner* — Prem C Singh
*Assistant Examiner* — Brandi M Doyle

(57) ABSTRACT

A process and adsorption vessel are provided for adsorbing asphaltenes from a hydrocarbon stream. Additionally, a process and adsorption vessel are provided for steam cracking a hydrocarbon stream containing asphaltenes by adsorbing asphaltenes from the hydrocarbon stream prior to steam cracking. Asphaltene adsorption is achieved through a carbon adsorbent having at least 25% of total pore volume provided by pores with pore diameter in the range of 0.1 to 2.0 micrometers and an oil adsorption number of at least 200.

13 Claims, 7 Drawing Sheets capacity E 0.1
X = B : Temperature
Y = C : WHSV

Actual Factor
A: P1 feed = 72.5 ppm

REMOVAL OF ASPHALTENE CONTAMINANTS FROM HYDROCARBON STREAMS USING CARBON BASED ADSORBENTS

CROSS REFERENCE TO RELATED APPLICATIONS

This application is a National Stage Application of, which claims benefit of and priority to, PCT Number PCT/US2009/047695filed Jun. 17, 2009, the entirety of which is incorporated herein by reference.

FIELD OF THE INVENTION

The present invention relates to upgrading hydrocarbon streams that contain non-volatile compounds. More particularly, the present invention relates to the removal of asphaltenes from hydrocarbon streams.

BACKGROUND OF THE INVENTION

Steam cracking, also referred to as pyrolysis, has long been used to crack various hydrocarbon feeds into olefins. Light olefins such as ethylene, propylene, and butene are preferred. Conventional steam cracking utilizes a pyrolysis furnace wherein the feed is heated sufficiently to cause thermal decomposition of the larger molecules. The pyrolysis furnace has two main sections: a convection section and a radiant section. The hydrocarbon feed enters the convection section of the furnace either already as a vapor or as a liquid which is vaporized through direct contact with steam and indirect contact with the burners in the radiant section. The vaporized feed then proceeds to the radiant section where cracking takes place. Non-volatiles in the convection section cause coking, and coking often results in costly shutdowns for cleaning.

Lower cost heavy feedstocks often include non-volatile components. These components are often tars and asphaltenes (collectively "asphaltenes") which are molecules of high molecular weight with multi-ring structures. Asphaltenes can be present in hydrocarbon feeds as naturally-occurring components, contaminants (e.g., those introduced during transport) and/or by-products formed during feed processing. In addition to causing coking, asphaltenes reduce the economic value of the hydrocarbon feed by rendering it less compatible for mixing with highly paraffinic streams, further inducing precipitation of the asphaltenes from the resulting mixture.

Various methods are known in the art to treat various feedstocks to reduce the asphaltenes content.

U.S. Pat. No. 3,948,756 discloses pentane insoluble asphaltene removal from residual petroleum oil by pretreating the feeds with hydrogen, resulting in a maximum conversion of asphaltenes when 5 to 45 volume percent of the 975° F.+ fraction in the feedstock is converted to lower boiling fractions.

U.S. Pat. No. 4,719,007 discloses the removal of trace asphaltenes from a hydrotreated feed by contacting with a carbon adsorbent.

U.S. Pat. No. 5,107,060 discloses treatment of mercury-containing hydrocarbon feedstocks such as liquid condensate from natural gas fields for use as a steam cracker feed by contacting with a mercury reactive adsorbent and a high surface area support such as active carbon.

U.S. Pat. No. 5,374,350 discloses hydrotreating hydrocarbon oil feedstock in the presence of a catalyst composition comprising (a) an activated carbon component derived from lignite possessing a pore volume in the 100 to 400 angstrom pore diameter range of at least about 0.08 cc/g., and an average pore diameter of 15 to 100 angstroms, and (b) a molybdenum or tungsten component and (c) a cobalt or nickel component.

In U.S. Pat. No. 6,245,223 a major portion of metals and coke precursors is removed from a hydrocarbon stream which may be effluent from a solvent deasphalter which includes a pentane solvent, by contacting with a hydrocarbon insoluble adsorbent selected from silica, silica-alumina, acid treated clays and activated carbons, recovering the oil which does not adsorb and removing the metals and coke precursors from the adsorbent.

In U.S. Pat. No. 6,303,842 pentane insolubles are removed from a residuum used as a steam cracking feed by solvent extraction prior to use.

"Effect of Clay Particle Size on the Adsorption of a Pentane Insoluble Bitumen Fraction," Tu Yun et al., Clay Sci, pp. 194-198 (2006), discloses the effect of clay particle size on the adsorption of a well-characterized pentane insoluble fraction (PI) from Athabasca oil sands bitumen by clay minerals.

U.S. patent application Ser. No. 11/958,433, filed Dec. 18, 2007 discloses thermally cracking hydrocarbon feeds containing paraffin insoluble compounds by selectively adsorbing paraffin-insoluble compounds with solid particulate adsorbents, prior to cracking. An aromatics-containing stream such as one derived from cracked product is used to desorb the paraffin insoluble compounds from the adsorber stage.

It would be desirable to upgrade asphaltene-containing hydrocarbon streams to provide a suitable stream for cracking using a regenerable adsorbent exhibiting a long adsorbent life. The present inventors have discovered a process for removing asphaltene contaminants in hydrocarbon streams by a carbon based adsorbent (preferably regenerable) under conditions which provide enhanced adsorbent life.

SUMMARY OF THE INVENTION

The invention relates to a process and related apparatus for removing asphaltenes from a hydrocarbon stream comprising: contacting said hydrocarbon stream with a carbon based adsorbent to adsorb said asphaltenes from said hydrocarbon stream to produce an asphaltene depleted hydrocarbon stream with at least 70% by weight less of said asphaltenes as compared to said hydrocarbon stream, wherein said carbon based adsorbent has at least 25% of total pore volume provided by pores with pore diameter in the range of 0.1 to 2.0 micrometers and an oil adsorption number of at least 200.

Additionally, the invention relates to a process and related apparatus for cracking a hydrocarbon stream comprising: i) contacting said hydrocarbon stream with a carbon based adsorbent to adsorb said asphaltenes from said hydrocarbon stream to produce an asphaltene depleted hydrocarbon stream with at least 70% by weight less of said asphaltenes as compared to said hydrocarbon stream, wherein said carbon based adsorbent has at least 25% of total pore volume provided by pores with pore diameter in the range of 0.1 to 2.0 micrometers and an oil adsorption number of at least 200; ii) passing said asphaltene depleted hydrocarbon stream to a steam cracking furnace; and iii) cracking said asphaltene depleted hydrocarbon stream in said steam cracking furnace.

These and other objects, features, and advantages will become apparent as reference is made to the following detailed description, preferred embodiments, examples, and appended claims.

DETAILED DESCRIPTION OF THE INVENTION

Figure 1:
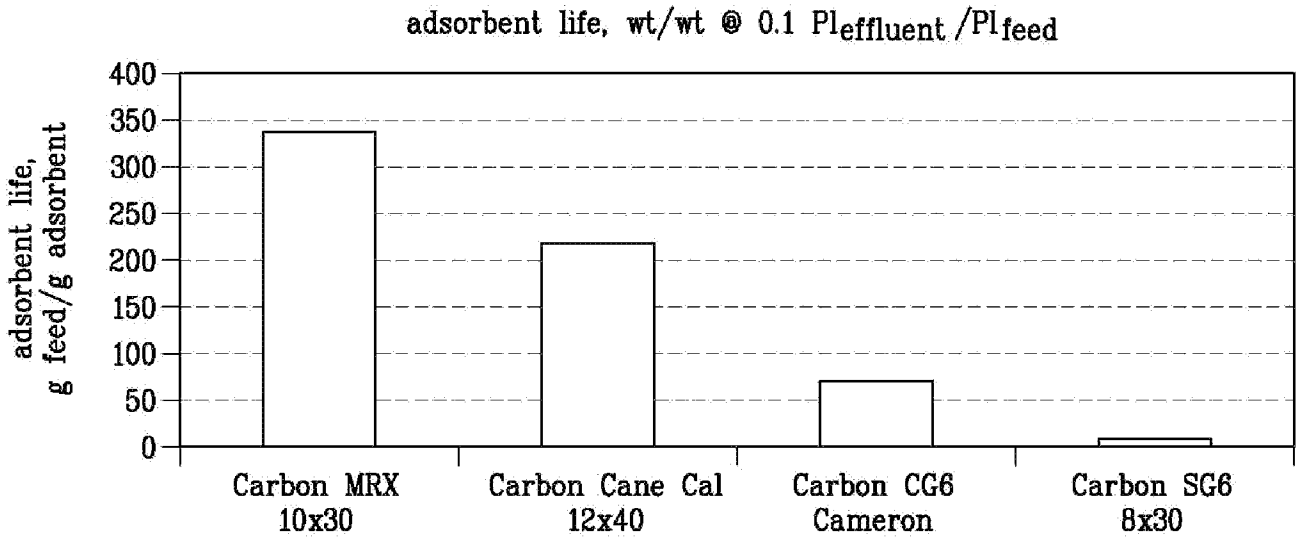
FIG. 1 depicts adsorbent life (wt/wt, @ $PI_{effluent}/PI_{feed}=0.1$) for four carbon-based adsorbents tested.

Unless otherwise stated, all percentages, parts, ratios, etc. are by weight. Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

All ASTM methods listed herein are in effect as of the filing date unless otherwise noted.

The following description relates to the preferred embodiments of the invention described herein. Alternative embodiments are possible without departing from the invention.

According to the invention, improved uptake kinetics and dynamic adsorption capacity for asphaltenes can be obtained by employing carbon based adsorbents with a specific pore size range and high oil absorption numbers (OANs).

As previously noted, the invention described herein relates to a process and related apparatus for removing asphaltenes from a hydrocarbon streams (such as crude petroleum streams) comprising: contacting said hydrocarbon stream with a carbon based adsorbent to adsorb said asphaltenes from said hydrocarbon stream to produce an asphaltene depleted hydrocarbon stream with at least 70% by weight less (preferably 80 wt % less, preferably 90 wt % less) of said asphaltenes as compared to said hydrocarbon stream, wherein said carbon based adsorbent has at least 25% of total pore volume (alternately at least 35 wt %, alternately at least 50 wt %) provided by pores with pore diameter in the range of 0.1 to 2.0 (alternately 0.1 to 1.5) micrometers and an OAN of at least 200 (preferably at least 300, preferably at least 320).

Additionally, the invention described herein relates to a process and related apparatus for cracking a hydrocarbon stream comprising: i) contacting said hydrocarbon stream with a carbon based adsorbent to adsorb said asphaltenes from said hydrocarbon stream to produce an asphaltene depleted hydrocarbon stream with at least 70% by weight less (preferably 80% less, preferably 90 wt % less) of said asphaltenes as compared to said hydrocarbon stream, wherein said carbon based adsorbent has at least 25% of total pore volume (alternately at least 35%, alternately at least 50%) provided by pores with pore diameter in the range of 0.1 to 2.0 (alternately 0.1 to 1.5) micrometers and an OAN of at least 200 (preferably at least 300, preferably at least 320); ii) passing said asphaltene depleted hydrocarbon stream to a steam cracking furnace; and iii) cracking said asphaltene depleted hydrocarbon stream in said steam cracking furnace.

Asphaltenes

Asphaltenes are materials derived from petroleum or natural gas (such as crude or refined petroleum streams) that are insoluble in n-heptane as determined by ASTM D-6560.

In a preferred embodiment, the asphaltenes treated herein are also insoluble in n-pentane. The measurement of PI may be conducted in a variety of ways. Two standard methods are ASTM D-893-05a and D-4055-04. ASTM D-893-05a is a centrifugal method and the preferred option of this method includes addition of a coagulant to help precipitate small insoluble particulates. ASTM D-4055-04 is a filtration method through a specified opening, such as one of 1.2 microns in diameter.

In one or more embodiments of the present invention, asphaltene-rich feeds to be treated by the present invention contain at least 10 ppmw, preferably 10 to 1000 ppmw, more preferably 50 to 500 ppmw PI (as determined by ASTM D-893-05a).

In another embodiment, the asphaltenes to be treated herein are soluble in toluene (as determined ASTM D-893-05a).

Hydrocarbon Streams

Suitable hydrocarbon streams containing asphaltenes for use in the present invention include naphtha boiling range materials, as well as those boiling with a final boiling point in a temperature range from above about 180° C., such as streams heavier than naphtha. Such streams include those boiling in the range from about 93° to about 649° C. (alternately from about 200° to about 1200° F.), alternately, from about from about 204° to about 510° C. (alternately from about 400° to about 950° F.). Typical heavier than naphtha streams can include heavy condensates, gas oils, kerosene, hydrocrackates, crude oils, and/or crude oil fractions. Preferably, the hydrocarbon stream is selected from natural gas condensates, low sulfur waxy residue, crude, vacuum resid, hydrotreated atmospheric resid, hydrotreated vacuum resid, and hydrotreated crude.

The hydrocarbon stream can comprise a large portion, such as from about 5 to about 50%, of non-volatile components, i.e., resid. Such streams could comprise, by way of non-limiting examples, one or more of steam cracked gas oils and residues, gas oils, heating oil, jet fuel, diesel, kerosene, gasoline, catalytically cracked naphtha, hydrocrackate, reformate, raffinate reformate, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, hydrocarbon gases/residue admixture, hydrogen/residue admixtures, gas oil/residue admixture, and crude oil. The foregoing hydrocarbon streams can have a nominal end boiling point of at least about 315° C. (alternately 600° F.), generally greater than about 510° C. (alternately 950° F.), typically greater than about 590° C. (alternately 1100° F.), for example, greater than about 760° C. (alternately 1400° F.).

Condensates containing asphaltenes, recovered from a natural gas stream are an especially suitable hydrocarbon stream for adsorption treatment by the invention described herein. Condensate occupies a niche between normally gaseous natural gas and normally liquid whole crude oil. Condensate contains hydrocarbons heavier than normally gaseous natural gas, and a narrow range of hydrocarbons that are at the lightest end of whole crude oil. Condensate, unlike crude oil, can be characterized by way of its boiling point range. Condensates normally boil in the range of from about 38° to about 343° C. (alternately 100° to about 650° F.). Within this boiling range, condensates contain a wide variety of hydrocarbonaceous materials. These materials can include compounds that make up fractions that are commonly referred to as naphtha, kerosene, diesel fuel(s), and gas oil (fuel oil, furnace oil, heating oil, and the like). Naphtha and associated lighter boiling materials (naphtha) are in the $C_5$ to $C_{10}$, inclusive, range, and are the lightest boiling range fractions in condensate, boiling in the range of from about 38° to about 204° C. (alternately 100° to about 400° F.). Petroleum distillates (kerosene, diesel, gas oil) are generally in the $C_{10}$ to about $C_{20}$ or slightly higher range, and generally boil, in their majority, in the range of from about 177° to about 343° C. (alternately 350° to about 650° F.). They are, individually and collectively, referred to herein as "distillate" or "distillates". It should be noted that various distillate compositions can have a boiling point lower than 177° C. (alternately 350° F.) and/or higher than 343° C. (alternately 650° F.), and such distillates are included in the 177° to about 343° C. (alternately 350° to about 650° F.) range aforesaid, and in the invention described herein.

In one or more embodiments of the present invention, asphaltene-rich hydrocarbon streams treated by the present invention contain at least 10 ppmw, preferably 10 to 1000 ppmw, more preferably 50 to 500 ppmw n-heptane insolubles.

In one or more embodiments of the present invention, asphaltene-rich hydrocarbon streams treated by the present invention contain at least 10 ppmw, preferably 10 to 1000 ppmw, more preferably 50 to 500 ppmw n-pentane insolubles.

In one embodiment of the present invention, the hydrocarbon stream is selected from gasoline, condensates, naphtha and gas oil, and the adsorbing conditions comprise a temperature ranging from 170° to 230° C., alternately a temperature ranging from 40° to 90° C.

In one or more embodiments of the present invention, the asphaltene compound-rich hydrocarbon stream has a pentane insolubles concentration ranging from 10 to 1000 ppmw, alternately from 50 to 500ppmw. Alternately, the stream can contain pentane insolubles greater than about 1.2 wt % as measured by the method described in ASTM D-893-05a, while the treated product contains pentane insolubles less than about 1.00, preferably less than 0.90 wt %, preferably less than 0.085 wt %, preferably less than 0.080 wt % as measured by the method described in ASTM D-893-05a.

In still another embodiment, asphaltene-rich hydrocarbon stream is selected from the group consisting of condensate, gas oil, naphtha, and distillate.

In yet still another embodiment, the asphaltene-rich hydrocarbon stream comprises heavy atmospheric gas oil, virgin gas oil, and light virgin naphtha.

Adsorption Process Conditions

In one embodiment of this aspect of the invention, the asphaltene adsorbing conditions comprise a temperature ranging from 40° to 300° C., a WHSV (grams feed/hour per gram adsorbent) ranging from 1 to 120 $hr^{-1}$, and a pressure ranging from 101 to 2169 kPa, alternately 0 to 300 psig.

In another embodiment, the process comprises using adsorption temperatures from 100° to 300° C., alternately 150° to 300° C.

In still another embodiment, the process comprises using a WHSV during adsorption of asphaltenes of less than 120 $hr^{-1}$, alternately 100 $hr^{-1}$, alternately 80 $hr^{-1}$.

In one or more embodiments of the present invention, increase of the kinetic adsorption capacity the carbon based adsorbent having at least 25% of total pore volume provided by pores with pore diameter in the range of 0.1 to 2.0 micrometers and an OAN of at least 200, under asphaltene adsorbing conditions, optionally comprises at least one of: 1) reducing particle size of adsorbent, 2) increasing adsorption temperature, 3) reducing WHSV during adsorption, and 4) increasing OAN.

In one or more embodiments of the present invention the asphaltene depleted hydrocarbon stream contains 70% less asphaltenes by weight than the hydrocarbon stream, preferably 75%, preferably 80%, preferably 85%, preferably 90%.

Adsorption Vessels

The hydrocarbon stream is contacted in an adsorption zone with adsorbent materials capable of adsorbing asphaltenes from the feed. The adsorption zone typically comprises one or more vessels of sufficient volume to allow adequate contact of the feed to be treated with the adsorbent materials. The vessel may contain a suitable mechanical mixing means to promote contact of the hydrocarbon stream and adsorbent material.

A suitable adsorber vessel comprises an inlet for the hydrocarbonaceous feed, and an outlet for removing asphaltene depleted effluent. An aromatics-containing desorber stream for regenerating adsorbent can be provided by a separate inlet or the same inlet used for the hydrocarbon feed. Similarly, a separate outlet can be provided for removing spent stream aromatics-containing streams that also contain asphaltenes after contact with the adsorbent particles; or the same outlet used for removing asphaltene depleted effluent can be used for this purpose. The adsorber vessel can also comprise a separate inlet/outlet for adding/removing adsorbent to the vessel. Alternately, the adsorbent can be added through other inlet(s) and outlet(s) of the vessel.

The adsorbent may be installed in the adsorption zone in any suitable manner. The vessel can be configured as a fixed bed, ebullating bed or slurry bed. All of these beds are well-known in the art, see O. Levenspiel, Chemical Reaction Engineering, 2nd Edition, Wiley, New York (1972) and Fluidization Engineering, Krieger, New York (1977). The adsorbent may be installed in one or more vessels and in either series or parallel flow. The flow of hydrocarbons through the adsorption zone is preferably performed in a parallel manner so that when one of the adsorbent beds or chambers is spent by the accumulation of asphaltenes thereon, the spent zone may be bypassed and the carbon based adsorbent replaced or regenerated while continuing uninterrupted operation through the parallel zone.

When the adsorbent in an adsorber vessel becomes ineffective in removing asphaltenes from the feed, or otherwise deactivated, the vessel can be taken out of service and subjected to replacement or regeneration by passing an aromatics-containing stream over the adsorbent. This stream, which is at least partially derived from the cracked product stream of the invention described herein is directed to the adsorber vessel in regeneration mode under conditions sufficient to remove asphaltenes from the adsorbent. The adsorption zone during regeneration can be maintained under conditions the same or different from those employed during adsorption, preferably at a pressure from about 101 kPa to about 2858 kPa (alternately 0 psig to about 400 psig), preferably from about 203 kPa to about 2169 kPa (alternately 15 psig to about 300 psig), a temperature from about 10° to about 400° C., preferably from about 20° to about 300° C. (alternately 68° to about 572° F.) and a WHSV from about 0.1 $hr^{-1}$ to about 1000 $hr^{-1}$, preferably from about 1 $hr^{-1}$ to about 500 $hr^{-1}$.

Aromatics-containing desorber streams may also include solvents such as toluene, toluene-methanol, or other appropriate solvents available in a refinery environment. In still other embodiments, the aromatics-containing stream can be provided by a mixture of aromatics-containing streams derived from the apparatus/process of the present invention itself and/or an externally supplied source.

Typically, the asphaltenes are washed off the adsorbent, and the resulting aromatics-containing stream containing these impurities is stripped in a suitable separation means such as a knockout drum and/or primary fractionator to provide an aromatics-rich stream and an asphaltene-rich stream. Overhead from the knockout drum can be directed to the primary fractionator for further processing and recycling. The knockout drum bottoms are collected as tar which can be further treated by a coker, partial oxidation unit or other disposal technique.

Aromatics-containing streams useful in the present invention to desorb the adsorbed asphaltenes typically contain from about 5 to about 100 wt % (alternately 10 to 80 wt %) aromatics as determined by gas chromatography as described in ASTM D-5986. Aromatics-containing streams derived from cracked product of the invention described herein typically contain from about 10 to about 80 wt % aromatics. In addition to the aromatics-containing stream, the adsorbent can be regenerated with a suitable supplemental desorber stream, e.g., steam or carbon dioxide.

The flow of the hydrocarbons through the adsorption zone may be conducted in an upflow, downflow or radial flow manner. The temperature and pressure of the adsorption zone are preferably selected to maintain the hydrocarbons in the liquid phase. After contacting the hydrocarbon feed with the carbon-based adsorbent, the effluent is upgraded to a stream with lowered asphaltene content. The upgraded stream flows on to further refining processing, such as a thermal cracker, where it is treated either directly or blended with other refinery streams, such as conventional vacuum gas oil (VGO).

In one embodiment, the process comprises regenerating the solid carbon-based asphaltene adsorbing material when the asphaltene depleted hydrocarbon stream contains more than 5 ppmw (alternately more than 2 ppmw) of the asphaltenes in the hydrocarbon stream entering the process.

In another embodiment, the regeneration is carried out by exposing the carbon based adsorbent to regenerating conditions which include temperatures from 40° to 300° C., pressure from between 203 kPa to about 2169 kPa (alternately 15 psig to about 300 psig), and a WHSV ranging from 1 to 100 $hr^{-1}$, in the presence of a liquid solvent capable of dissolving asphaltenes.

Carbon Based Adsorbents

Pore size distributions are determined using mercury porosimetry. Mercury porosimetry is performed according to ASTM D4284-07.

OANs are determined according to ASTM D2414-08a.

Suitable carbon based adsorbents for the present invention are those adsorbents capable of selectively adsorbing asphaltenes. Such adsorbents include hydrocarbon insoluble carbonaceous materials, e.g., activated carbons, preferably having surface areas greater than 100 $m^2/g$. Preferably, the surface areas are no greater than about 1000 $m^2/g$. Such particles range in size from about 5 mesh to about 100 mesh, preferably from about 8 mesh to about 60 mesh.

Examples of useful materials include activated carbon, unactivated carbon, carbon black, graphitized carbon, charcoal, coke, and coal. Specific materials include 1) Carbon MRX, a 10×30 mesh, activated granular carbon available from Calgon Carbon of Pittsburgh, Pa., USA; 2) Carbon Cane Cal, a 12×40 mesh, reagglomerated bituminous coal base activated carbon typically containing from 5 to 10% magnesite with added buffer, used for the purification of cane sugar, and available from Calgon Carbon of Pittsburgh, Pa., USA; and 3); Carbon CG6, an activated high activity granulated carbon (available as 12×40 mesh and 8×30 mesh) made from bituminous coal, available from Cameron Carbon, Inc. of Havre de Grace, Md., USA.

In one embodiment, the carbon based adsorbent is selected from the group consisting of activated carbon, unactivated carbon, carbon black, graphitized carbon, charcoal, coke, and coal.

In another embodiment, the carbon based adsorbent comprises reagglomerated coal base virgin activated carbon.

In another embodiment, the contacting is carried out in a fixed bed reactor.

In yet another embodiment, the carbon based adsorbent contains pores with pore diameters ranging from 0.1 to 2.0 micrometers, alternately from 0.1 to 1.5 micrometers which provide at least 25% of total pore volume.

In yet another embodiment, the carbon based adsorbent has an OAN of at least 200, alternately ranging from 250 to 400, alternately ranging from 300 to 325.

In yet another embodiment, the carbon based adsorbent has a particle size reduced from 8-30 mesh to 40-60 mesh, alternately from 8-30 mesh to 80-120 mesh, alternately 40-60 mesh to 80-120 mesh.

In some embodiments, when the carbon based adsorbent is present in granular form, any of the carbon based adsorbent materials described herein may have one or more of the following properties: 1) an iodine number (ASTM 4607) of 200 to 1500 mg/g, alternately 925 to 1050 mg/g, alternately 925 to 975 mg/g; and or 2) a wt % moisture—as packed—(ASTM 2867) of 0 to 10 wt %, alternately 0 to 6 wt %, alternately 0-4 wt %; and or 3) a mean particle diameter of 0.1 to 3.0 mm, alternately 0.5 to 1.5 mm, alternately 0.8 to 1.2 mm, alternately 0.9 to 1.1 mm; and or 4) an ash content of 0 to 20 wt %, alternately 0.5 to 15 wt %, alternately 1 to 10 wt %; and or 5) when in particulate form, preferably 80 wt % or more (preferably 85 wt % or more, preferably 90 wt % or more, preferably 95 wt % or more, preferably 97 wt % or more) of the particles have a particle size of 8 mesh to 140 mesh (using US Sieve series), alternately 12 mesh to 40 mesh, alternately 10 to 30 mesh, alternately 10 to 20 mesh.

In another embodiment, any of the carbon based adsorbent materials described herein are 100 wt % carbon, alternately the carbon based adsorbent materials described herein may have up to 80% heteroatoms (atoms other than C and H), alternately up to 30 wt %, alternately up to 20 wt %, alternately up to 10 wt %. Alternately the carbon based adsorbent materials described herein may have up to 50 wt % metal oxides, such as MgO and AlO, alternately up to 15%, alternately 10 wt %, alternately up to 8 wt %.

The invention is further illustrated by the following Examples which are provided for the purpose of representation and are not to be construed as limiting the scope of the invention. Unless stated otherwise, all percentages, parts, etc., are by weight.

EXAMPLE 1

Adsorbent life was measured in a fixed bed reactor, containing one gram of a carbon adsorbent of 40-60 mesh particle size. The adsorbents were dried prior to use at 100° C. for 16 hours. The reactor temperature was kept at 200° C. and the pressure was set at 2127 kPa (alternately 21 barg or 294 psig). WHSV (grams feed/hour per gram adsorbent) was set at 100 $hr^{-1}$. Sabine Island condensate, containing 75 ppm PI, was used as a feed. Adsorbent life is defined as the amount of feed in grams per gram of adsorbent fed to the reactor to the point where 90% of the PI's in the feed have been removed. FIG. 1 depicts the adsorbent life (wt/wt, @ $PI_{effluent}/PI_{feed}$=0.1) for the carbons which were tested.

The carbons tested were 1) Carbon MRX™, a 10×30 mesh, activated granular carbon available from Calgon Carbon of Pittsburgh, Pa., USA; 2) Carbon Cane Cal™, a 12×40 mesh, reagglomerated bituminous coal base activated carbon typically contains from 5 to 10% magnesite with added buffer, used for the purification of cane sugar, and available from Calgon Carbon of Pittsburgh, Pa., USA; 3); Carbon CG6™, an activated high activity granulated carbon (12×40 mesh or 8×30 mesh) made from bituminous coal, available from Cameron Carbon, Inc. of Havre de Grace, Md., USA; and 4) Carbon SG6™, an activated high activity granulated carbon (8×30 mesh) made from coconut shell, and available from Cameron Carbon, Inc. of Havre de Grace, Md., USA.

Pore distributions of the four carbons tested were measured using mercury porosimetry on a Micromeretics AutoPore IV 9500 available from Micromeretics Instrument Corporation of Norcross, Ga., according to ASTM D4284-07.

Figure 2:
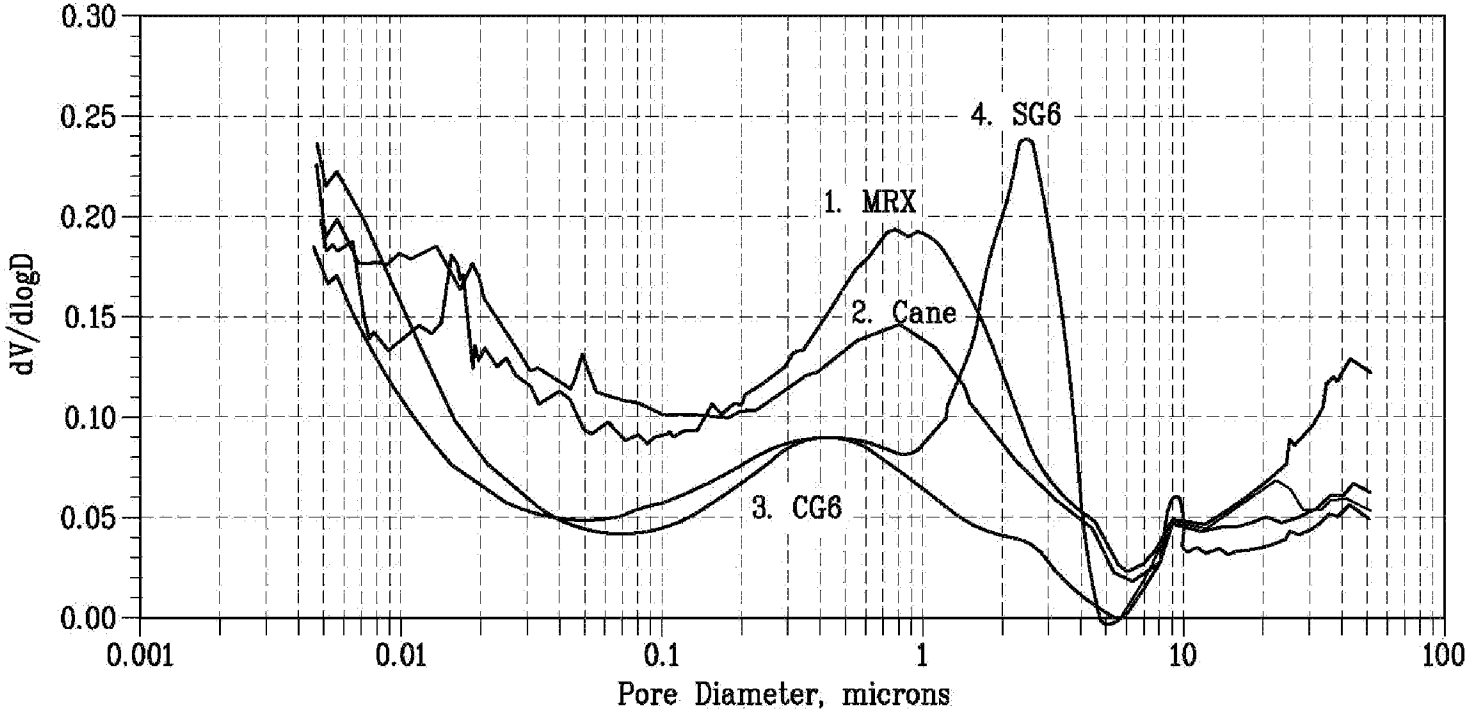
FIG. 2 depicts the mercury porosimetry results dVolume/(dlogpore diameter) showing the macropore distribution for the four carbon-based adsorbents of FIG. 1.

The pore distribution for the tested carbons is set out in FIG. 2 for four carbon-based adsorbents tested, including those used in the present invention. It is apparent from FIG. 2 that the carbon adsorbent with the highest fraction of pores in the range of 0.1 to 2.0 microns, particularly in the range of 0.1 to 1.5 microns, was MRX. MRX additionally provided the highest adsorbent life in the PI removal test as depicted in FIG. 1.

EXAMPLE 2

Figure 3:
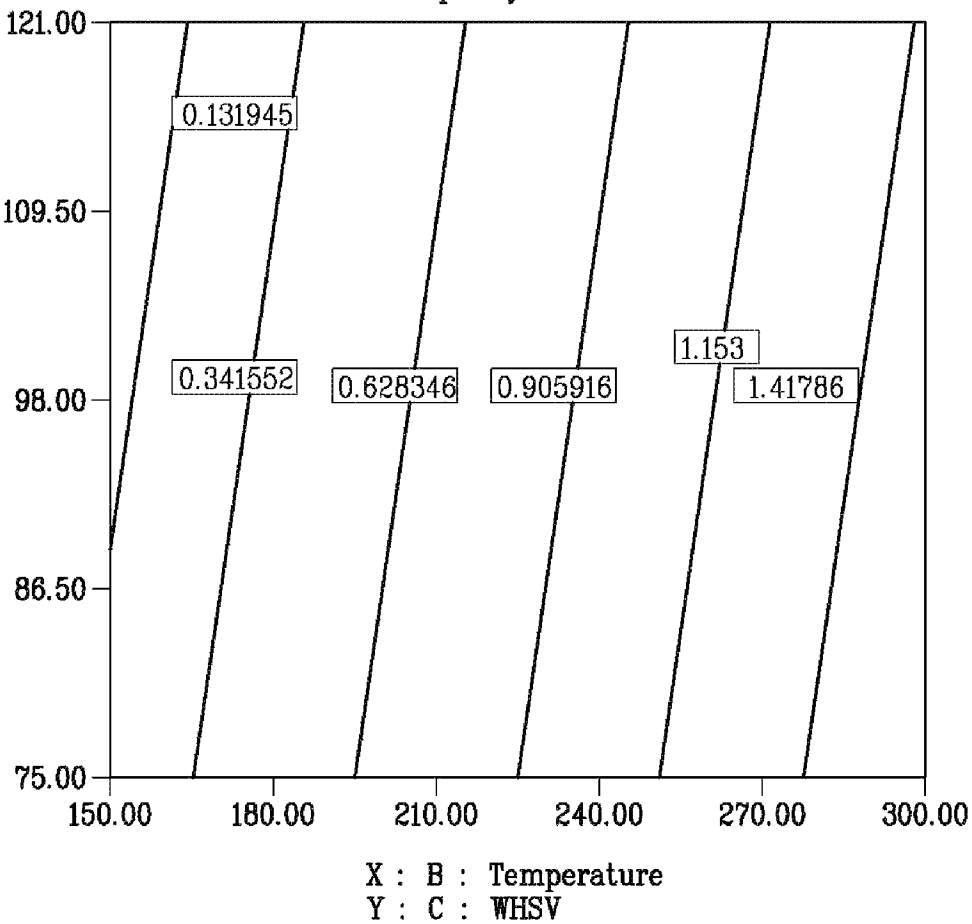
FIG. 3 depicts an experimental grid corresponding to a full factorial design with three parameters—temperature, pentane insolubles (PI) concentration and weight hourly space velocity (WHSV) and shows the relation between kinetic adsorption capacity (adsorbent life) at $PI_{effluent}/PI_{feed}$=0.1 and PI feed concentration=73 ppm at varying temperatures and space velocities.

Operating conditions (reactor temperature and WHSV) were modified to determine the relationship between operating conditions and kinetic capacity. The reactor temperature was varied between 170° C. and 230° C. and the pressure was set at 2127 kPa (alternately 21 barg or 294 psig). WHSV (grams feed/hour per gram adsorbent) was varied between 65 and about 120 $hrs^{-1}$ as the temperature increased. Adsorbent life was again measured in a fixed bed reactor, containing one gram of a carbon adsorbent of 40-80 mesh particle size. The adsorbent, Carbon CG6™ (described above) of 60-40 mesh size was obtained by crushing and sieving. The adsorbent was dried prior to use at 100° C. for 16 hours. Sabine Island condensates, varying between 22 and 130 ppm PI, were used as a feed. Adsorbent life is defined as the amount of feed in grams per gram of adsorbent fed to the reactor to the point where 90% of the PI's in the feed have been removed. FIG. 3 depicts an experimental grid corresponding to a full factorial design with three parameters—temperature, PI concentration, and WHSV—showing adsorbent life (wt/wt, @ $PI_{effluent}/PI_{feed}$=0.1) for the carbon which was tested. The mathematical relation between kinetic capacity (or adsorbent life) @ $PI_{effluent}/PI_{feed}$=0.1, WHSV and temperature is given by: Kinetic Capacity=−0.095+9.6 $10^{-1}$×Temperature(° C.)−4.07 $10^{-3}$×WHSV.

FIG. 3 shows, unexpectedly, an increase in capacity as the process temperature increases. The adsorbent capacity/adsorbent life also increases as the WHSV is reduced, reflecting a longer residence time. Additional experimentation at feeds of differing PI concentrations in the feed ranging between 22 and 130 ppm PI in the feed, indicated that capacity was not a function of the PI concentration.

EXAMPLE 3

Figure 4:
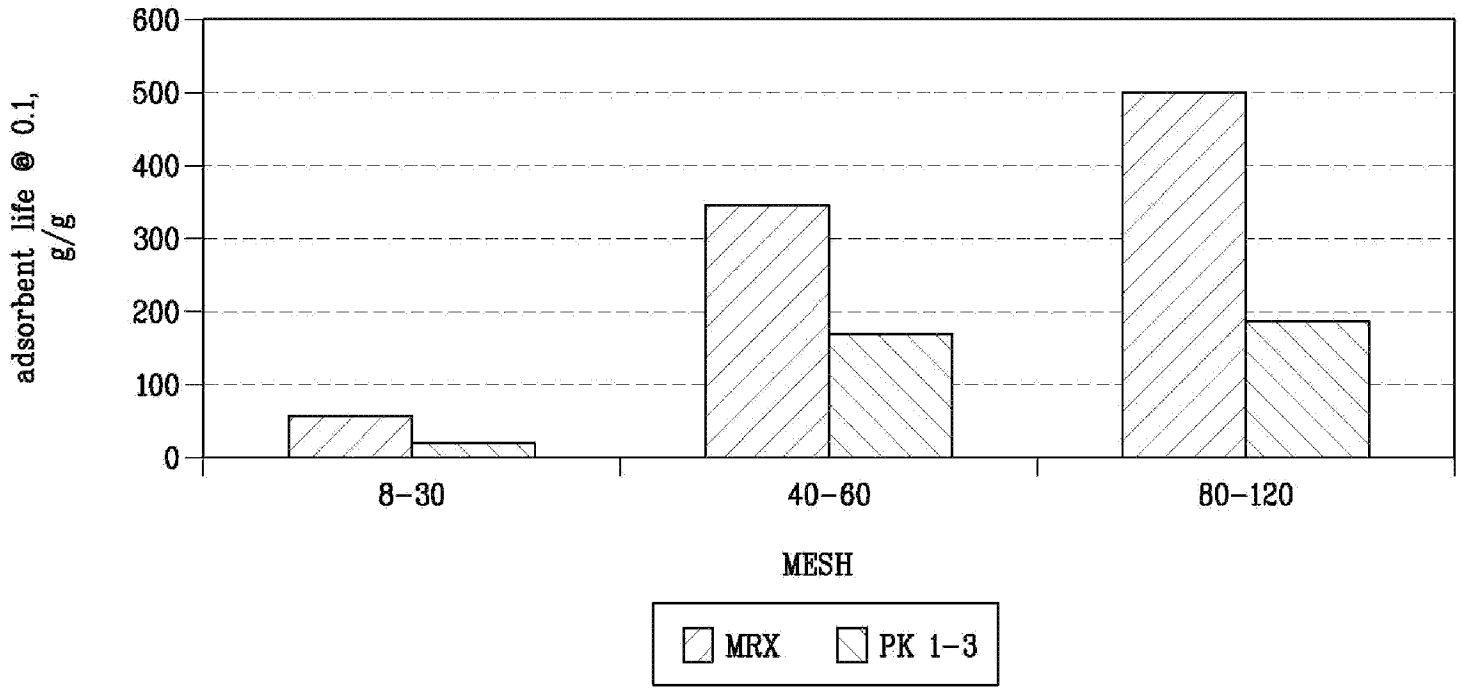
FIG. 4 depicts the effect of particle size on adsorbent life (wt/wt, @ $PI_{effluent}/PI_{feed}$=0.1) at 200° C., and 100 WHSV for a feed containing 75 ppm pentane insolubles, for two carbon-based adsorbents tested.

Effect of adsorbent particle size on two different carbons was tested at 8-30 mesh, 40-60 mesh, and 80-120 mesh. Carbon MRX™, described above, and Norit PK 1-3™ granular activated carbon produced using steam activation, available from Norit Americas, Inc., Marshall, Tex., USA, were tested at the varying particle sizes. Adsorbent life was measured in a fixed bed reactor, containing one gram of a carbon adsorbent of 40-60 mesh particle size. The adsorbents were dried prior to use at 100° C. for 16 hours. The reactor temperature was kept at 200° C. and the pressure was set at 2127 kPa (alternately 21 barg or 294 psig). WHSV (grams feed/hour per gram adsorbent) was set at 100 $hrs^{-1}$. Sabine Island condensate, containing 75 ppm PI, was used as a feed. Adsorbent life was optimized at a particle size of 80-120 mesh for both carbon adsorbents, with Carbon MRX™ showing an adsorbent life of 50 g/g, 350 g/g and 500g/g for 8-30 mesh, 40-60 mesh, and 80-120 mesh, respectively. Similarly, Norit PK 1-3™ showed an adsorbent life of about 20 g/g, 165 g/g and 185 g/g for 8-30 mesh, 40-60 mesh, and 80-120 mesh, respectively. FIG. 4 clearly shows a significant increase in adsorbent life as adsorbent particle size is reduced.

EXAMPLE 4

Effect of absorption number was tested for two different carbons having a high OAN. The OAN of a carbon black is related to the processing and vulcanizate properties of rubber compounds containing carbon black.

Adsorbent life was measured in a fixed bed reactor, containing one gram of a carbon adsorbent of 40-60 mesh particle size. The adsorbents were dried prior to use at 100° C. for 16 hours. The reactor temperature was varied between 40° C. and 90° C. and the pressure was set at 2127 kPa (alternately 21 barg or 294 psig). WHSV (grams feed/hour per gram adsorbent) was varied between 8 and 60 $hrs^{-1}$. Sabine Island condensate, containing 90 ppm PI, was used as the feed. Ketjenblack EC-300J™, a very pure carbon black having an OAN between 310 and 345 and spheroidal surface area of 802 $m^2/g$ available from Akzo Nobel, Amersfoort, Netherlands, and Ensaco 350G™, having an OAN of 320, is available from TIMCAL, Bodio, Switzerland.

Figure 5:
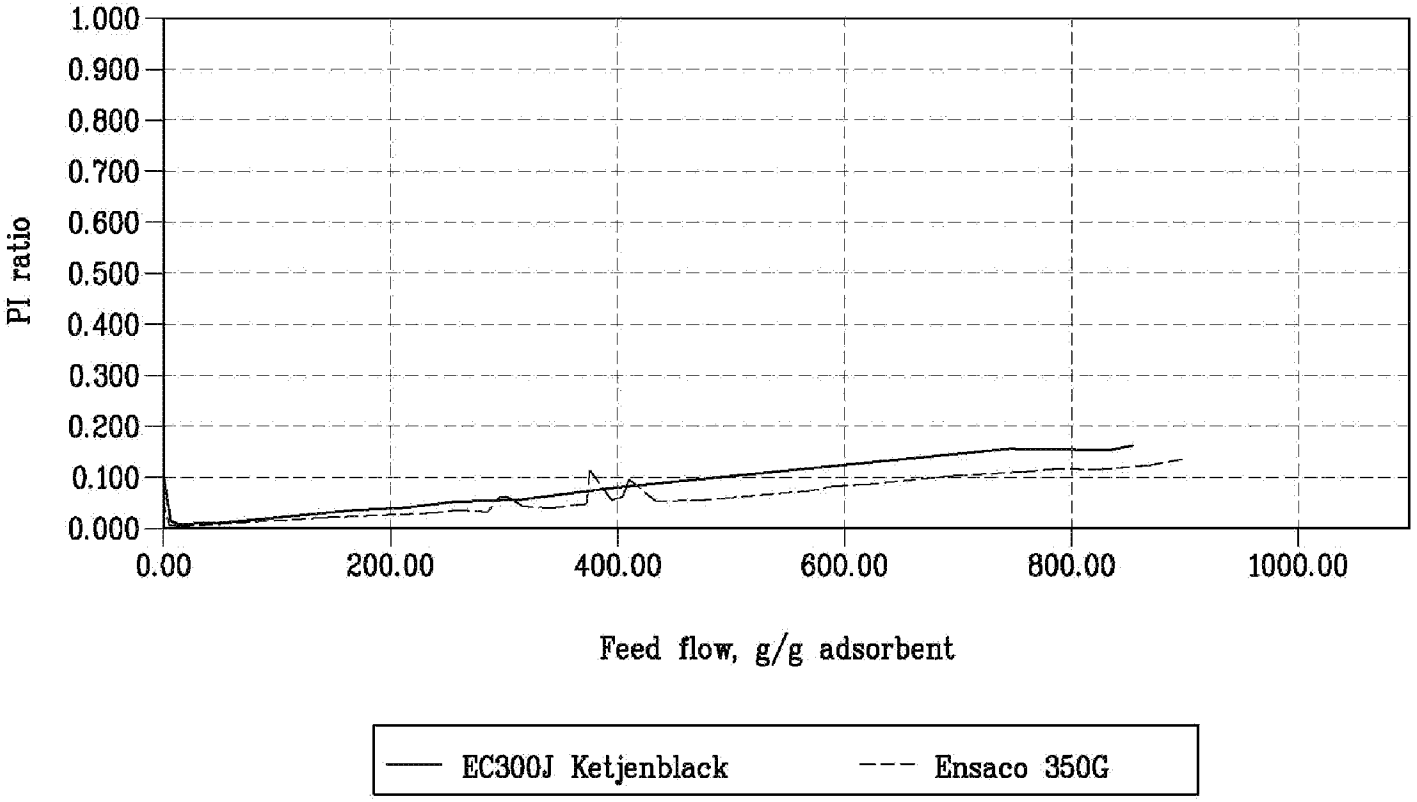
FIG. 5 depicts a breakthrough curve for two carbon-based adsorbents of high Oil Absorption Number in terms of PI ratio over feed flow (grams of feed/gram of adsorbent).

FIG. 5 depicts breakthrough curves (PI ratio versus feed flow) for Ensaco 350 G™ and Ketjenblack EC-300J™ at 40° C., WHSV of 8 $hr^{-1}$ using a 92 ppm PI feed. Excellent adsorbent life of about 600 g feed/g adsorbent was observed for both carbons even when operating near room temperature.

Figure 6:
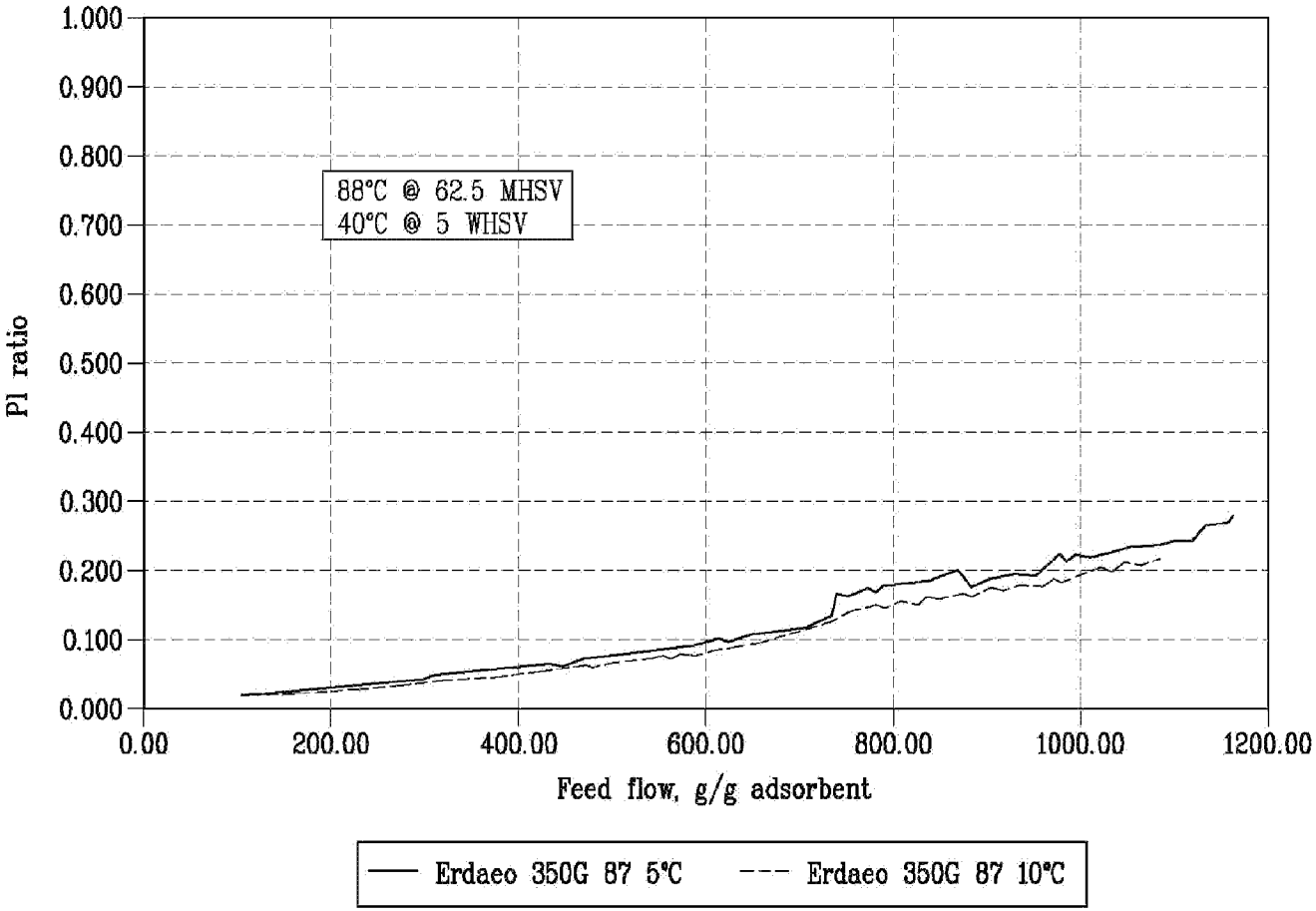
FIG. 6 depicts a breakthrough curve for a single carbon-based adsorbent of high Oil Absorption Number in terms of PI ratio over feed flow (grams of feed/gram of adsorbent) showing that increased operating temperature allows increasing WHSV throughput while maintaining the same adsorbent life.

Additional runs were made for Ensaco 350 G™ which varied operating temperature and WHSV. FIG. 6 depicts breakthrough curves (PI ratio versus feed flow) for Ensaco 350 G™ at 40° C. at WHSV=5 $hr^{-1}$, and 88° C. at WHSV=62.5 $hr^{-1}$. FIG. 6 shows that increasing operating temperature allows maintaining roughly equivalent adsorbent life while significantly increasing throughput (WHSV).

EXAMPLE 5

Adsorption capacity for PI was tested for four different adsorbents in semi-continuous batch experiments. The adsorbents tested were Attapalgas clay, Filtrol clay, Cameron CG6 carbon™, and Cameron SG6™ carbon.

The feeds used were condensate with 67 ppm PI and condensate with 174 ppm PI. First, the feed and an adsorbent were mixed in a sealed bottle with a weight of feed to weight of adsorbent ratio of 4. Second, the sealed bottle was kept at room temperature and pressure with periodic shaking. Third, after 24 hours, the supernatant liquid was decanted and analyzed for PI concentration. Fourth, steps 1-3 were repeated on the same adsorbent from step 3. For Attapalgas clay and CG6 carbon™, steps 1-3 were repeated 60 times for a total of 61 tests performed for each. For Filtrol clay and SG6 carbon™, steps 1-3 were repeated 13 times for a total of 14 tests for each.

Figure 7:
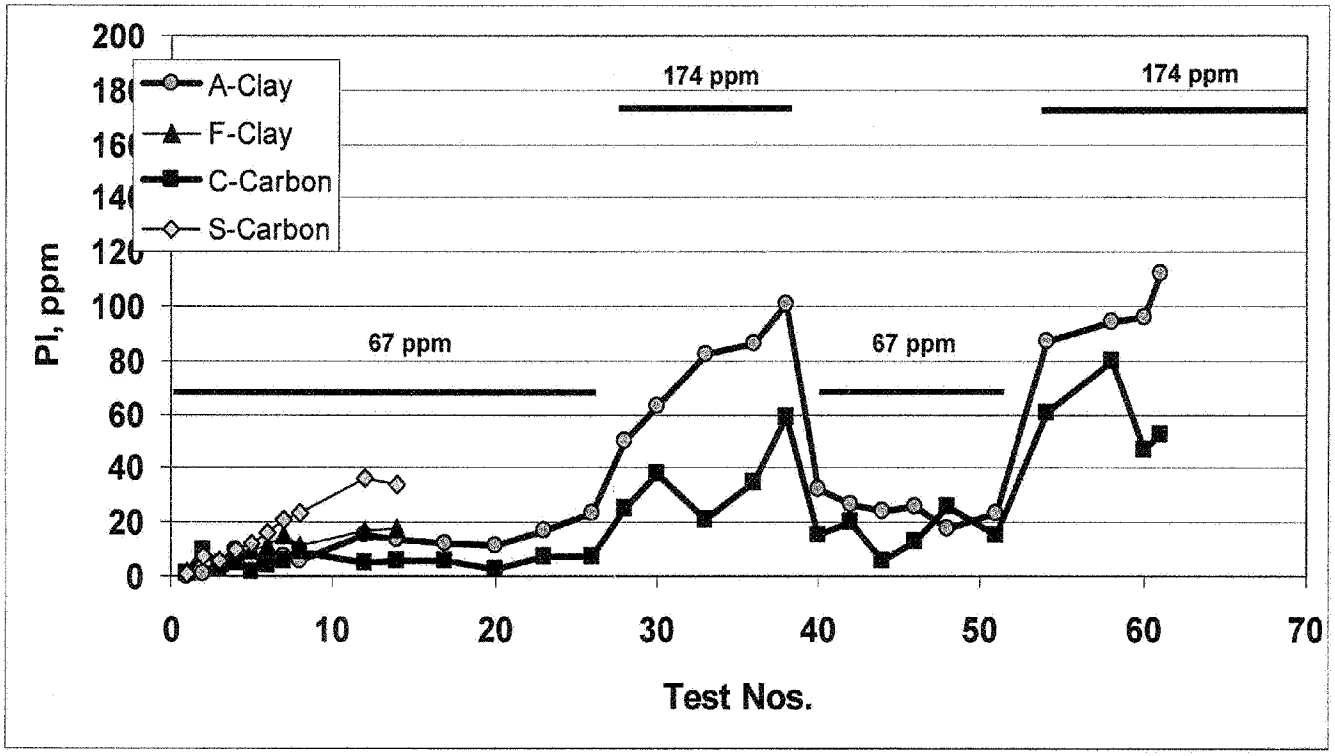
FIG. 7 depicts the PI concentration (ppm) for two carbon adsorbents and two clay adsorbents in a semi-continuous batch process.

FIG. 7 shows that the order of decreasing pentane insoluble adsorption capacity is CG6 carbon™>Attapalgas clay>Filtrol clay>SG6 carbon™.

In other embodiments, the invention relates to:

1. A process for removing asphaltenes from a hydrocarbon stream comprising:
   contacting said hydrocarbon stream with a carbon based adsorbent to adsorb said asphaltenes from said hydrocarbon stream to produce an asphaltene depleted hydrocarbon stream with at least 70% by weight less of said asphaltenes as compared to said hydrocarbon stream, wherein said carbon based adsorbent has at least 25% of total pore volume provided by pores with pore diameter in the range of 0.1 to 2.0 micrometers and an oil adsorption number of at least 200.
2. The process of paragraph 1, wherein said asphaltenes are adsorbed under conditions comprising a temperature in the range of 40° to 300° C., a weight hourly space velocity in the range of 1 to 120 $hr^{-1}$, and a pressure in the range of 203 kPa to about 2169 kPa.
3. The process of paragraphs 1 or 2, wherein said contacting is performed in a fixed bed reactor.
4. The process of paragraphs 1, 2, or 3, further comprising regenerating said carbon based adsorbent.
5. The process of paragraphs 1, 2, 3, or 4, wherein said regenerating regenerates said carbon based adsorbent when said carbon based adsorbent is contacted with a liquid solvent capable of dissolving asphaltenes at temperatures from 40° to 300° C. and pressures from 203 kPa to about 2169 kPa.
6. The process of paragraphs 1, 2, 3, 4, or 5, wherein said liquid solvent capable of dissolving asphaltenes is an aromatic-containing stream derived from product produced by a steam cracking furnace.
7. An adsorption vessel for removing asphaltenes from a hydrocarbon stream comprising:
   a carbon based adsorbent, wherein said carbon based adsorbent adsorbs said asphaltenes from said hydrocarbon stream to produce an asphaltene depleted hydrocarbon stream with at least 70% by weight less of said asphaltenes as compared to said hydrocarbon stream, wherein said carbon based adsorbent has at least 25% of total pore volume provided by pores with pore diameter in the range of 0.1 to 2.0 micrometers and an oil adsorption number of at least 200.
8. The adsorption vessel of paragraph 7, wherein said asphaltenes are adsorbed under conditions comprising a temperature in the range of 40° to 300° C., a weight hourly space velocity in the range of 1 to 120 $hr^{-1}$, and a pressure in the range of 203 kPa to about 2169 kPa.
9. The adsorption vessel of paragraphs 7 or 8, wherein said adsorption vessel is a fixed bed reactor.
10. The adsorption vessel of paragraphs 7, 8 or 9, wherein said carbon based adsorbent is regenerated.
11. The adsorption vessel of paragraphs 7, 8, 9 or 10, wherein said carbon based adsorbent is regenerated when said carbon based adsorbent is contacted with a liquid solvent capable of dissolving asphaltenes at temperatures from 40° to 300° C. and pressures from 203 kPa to about 2169 kPa.
12. The adsorption vessel of paragraphs 7, 8, 9, 10 or 11, wherein said liquid solvent capable of dissolving asphaltenes is an aromatic-containing stream derived from product produced by a steam cracking furnace.
13. A process for cracking a hydrocarbon stream comprising:
   contacting said hydrocarbon stream with a carbon based adsorbent to adsorb said asphaltenes from said hydrocarbon stream to produce an asphaltene depleted hydrocarbon stream with at least 70% by weight less of said asphaltenes as compared to said hydrocarbon stream, wherein said carbon based adsorbent has at least 25% of total pore volume provided by pores with pore diameter in the range of 0.1 to 2.0 micrometers and an oil adsorption number of at least 200;
   passing said asphaltene depleted hydrocarbon stream to a steam cracking furnace; and
   cracking said asphaltene depleted hydrocarbon stream in said steam cracking furnace.
14. The process of paragraph 13, wherein said asphaltenes are adsorbed under conditions comprising a temperature in the range of 40° to 300° C., a weight hourly space velocity in the range of 1 to 120 $hr^{-1}$, and a pressure in the range of 203 kPa to about 2169 kPa.
15. The process of paragraphs 13 or 14, wherein said contacting is performed in a fixed bed reactor.
16. The process of paragraphs 13, 14 or 15, further comprising regenerating said carbon based adsorbent.
17. The process of paragraphs 13, 14, 15 or 16, wherein said regenerating regenerates said carbon based adsorbent when said carbon based adsorbent is contacted with a liquid solvent capable of dissolving asphaltenes at temperatures from 40° to 300° C. and pressures from 203 kPa to about 2169 kPa.
18. The process of paragraphs 13, 14, 15, 16 or 17, wherein said liquid solvent capable of dissolving asphaltenes is an aromatic-containing stream derived from product produced by said steam cracking furnace.
19. An adsorption vessel for cracking a hydrocarbon stream comprising:
   a carbon based adsorbent, wherein said carbon based adsorbent when said carbon based adsorbent adsorbs said asphaltenes from said hydrocarbon stream to produce an asphaltene depleted hydrocarbon stream with at least 70% by weight less of said asphaltenes as compared to said hydrocarbon stream, wherein said carbon based adsorbent has at least 25% of total pore volume provided by pores with pore diameter in the range of 0.1 to 2.0 micrometers and an oil adsorption number of at least 200; and
   a steam cracking furnace wherein said steam cracking furnace cracks said asphaltene depleted hydrocarbon stream.
20. The adsorption vessel of paragraph 19, wherein said asphaltenes are adsorbed under conditions comprising a temperature in the range of 40° to 300° C., a weight hourly space velocity in the range of 1 to 120 $hr^{-1}$, and a pressure in the range of 203 kPa to about 2169 kPa.
21. The adsorption vessel of paragraphs 19 or 20, wherein said adsorption vessel is a fixed bed reactor.
22. The adsorption vessel of paragraphs 19, 20 or 21, wherein said carbon based adsorbent is regenerated.
23. The adsorption vessel of paragraphs 19, 20, 21 or 22, wherein said carbon based adsorbent is regenerated when said carbon based adsorbent is contacted with a liquid solvent capable of dissolving asphaltenes at temperatures from 40° to 300° C. and pressures from 203 kPa to about 2169 kPa.

24. The adsorption vessel of paragraphs 19, 20, 21 or 22, wherein said liquid solvent capable of dissolving asphaltenes is an aromatic-containing stream derived from product produced by said steam cracking furnace.

All patents and patent applications, test procedures (such as ASTM methods, UL methods, and the like), and other documents cited herein are fully incorporated by reference to the extent such disclosure is not inconsistent with this text and for all jurisdictions in which such incorporation is permitted. As is apparent from the foregoing general description and the specific embodiments, while forms of the invention have been illustrated and described, various modifications can be made without departing from the spirit and scope of the invention. Accordingly, it is not intended that the invention be limited thereby. Likewise, the term "comprising" is considered synonymous with the term "including" for purposes of Australian law. When numerical lower limits and numerical upper limits are listed herein, ranges from any lower limit to any upper limit are contemplated.

What is claimed is:

1. A process for removing asphaltenes from a hydrocarbon stream comprising:

contacting said hydrocarbon stream with a carbon based adsorbent to adsorb said asphaltenes from said hydrocarbon stream to produce an asphaltene depleted hydrocarbon stream with at least 70% by weight less of said asphaltenes as compared to said hydrocarbon stream, wherein said carbon based adsorbent comprises granular particles having a size in the range of about 7 to about 100 mesh, and has at least 25% of total pore volume provided by pores with pore diameter in the range of 0.1 to 2.0 micrometers and an oil adsorption number of at least 200.

2. The process of claim 1, wherein said asphaltenes are adsorbed under conditions comprising a temperature in the range of 40° to 300° C., a weight hourly space velocity in the range of 1 to 120 $hr^{-1}$, and a pressure in the range of 203 kPa to about 2169 kPa.

3. The process of claim 1, wherein said contacting is performed in a fixed bed reactor.

4. The process of claim 1, further comprising regenerating said carbon based adsorbent.

5. The process of claim 4, wherein said regenerating regenerates said carbon based adsorbent when said carbon based adsorbent is contacted with a liquid solvent capable of dissolving asphaltenes at temperatures from 40° to 300° C. and pressures from 203 kPa to about 2169 kPa.

6. The process of claim 5, wherein said liquid solvent capable of dissolving asphaltenes is an aromatic-containing stream derived from product produced by a steam cracking furnace.

7. The process of claim 1, wherein the carbon based adsorbent is characterized by a peak in pore diameter between 0.01 and 2 microns.

8. A process for cracking a hydrocarbon stream comprising:

contacting said hydrocarbon stream with a carbon based adsorbent to adsorb said asphaltenes from said hydrocarbon stream to produce an asphaltene depleted hydrocarbon stream with at least 70% by weight less of said asphaltenes as compared to said hydrocarbon stream, wherein said carbon based adsorbent comprises granular particles having a size in the range of about 7 to about 100 mesh, and has at least 25% of total pore volume provided by pores with pore diameter in the range of 0.1 to 2.0 micrometers and an oil adsorption number of at least 200;

passing said asphaltene depleted hydrocarbon stream to a steam cracking furnace; and cracking said asphaltene depleted hydrocarbon stream in said steam cracking furnace.

9. The process of claim 8, wherein said asphaltenes are adsorbed under conditions comprising a temperature in the range of 40° to 300° C., a weight hourly space velocity in the range of 1 to 120 $hr^{-1}$, and a pressure in the range of 203 kPa to about 2169 kPa.

10. The process of claim 8, wherein said contacting is performed in a fixed bed reactor.

11. The process of claim 8, further comprising regenerating said carbon based adsorbent.

12. The process of claim 11, wherein said regenerating regenerates said carbon based adsorbent when said carbon based adsorbent is contacted with a liquid solvent capable of dissolving asphaltenes at temperatures from 40° to 300° C. and pressures from 203 kPa to about 2169 kPa.

13. The process of claim 12, wherein said liquid solvent capable of dissolving asphaltenes is an aromatic-containing stream derived from product produced by said steam cracking furnace.

* * * * *